United States Patent [19]

Scungio

[11] Patent Number: 5,020,348

[45] Date of Patent: Jun. 4, 1991

[54] KEY RING

[75] Inventor: Robert A. Scungio, West Warwick, R.I.

[73] Assignee: Linden D. Nelson, Birmingham, Mich.

[21] Appl. No.: 473,593

[22] Filed: Feb. 2, 1990

[51] Int. Cl.[5] ..... A47G 29/10

[52] U.S. Cl. ..... 70/456 R; 70/459

[58] Field of Search ..... 70/459, 456 R; 24/312; D3/61-65; 40/2 R, 10 R, 10 D, 15 R, 1 B, 20 R

[56] References Cited

U.S. PATENT DOCUMENTS

| | | | |
|---|---|---|---|
| D. 306,799 | 3/1990 | Colan . | |
| 2,451,093 | 10/1948 | Kaminer | 70/456 R |
| 2,527,491 | 10/1950 | Ballou | 70/459 |
| 3,126,603 | 3/1964 | Cedaistaff | 70/459 |
| 4,129,021 | 12/1978 | Brentini . | |
| 4,164,132 | 8/1979 | Loman | 70/456 R |
| 4,317,638 | 3/1982 | Klaber | 70/459 |

FOREIGN PATENT DOCUMENTS

| | | | |
|---|---|---|---|
| 1397455 | 3/1965 | France | 70/459 |

*Primary Examiner*—Robert L. Wolfe
*Attorney, Agent, or Firm*—Spencer & Frank

[57] ABSTRACT

A double ended key ring includes a housing and a cover which are pivotally connected. A bias mechanism urges the housing and cover into an open position thereby providing access to an opening therebetween for mounting or removing keys or keyholders. A latch mechanism is pivotally mounted relative to the housing for releasably holding the cover in the closed position. The entire bias mechanism and the latch mechanism is effectively concealed when the key ring is in the engaged or closed position, in which position the removal of keyholders is precluded.

8 Claims, 1 Drawing Sheet

FIG. 1
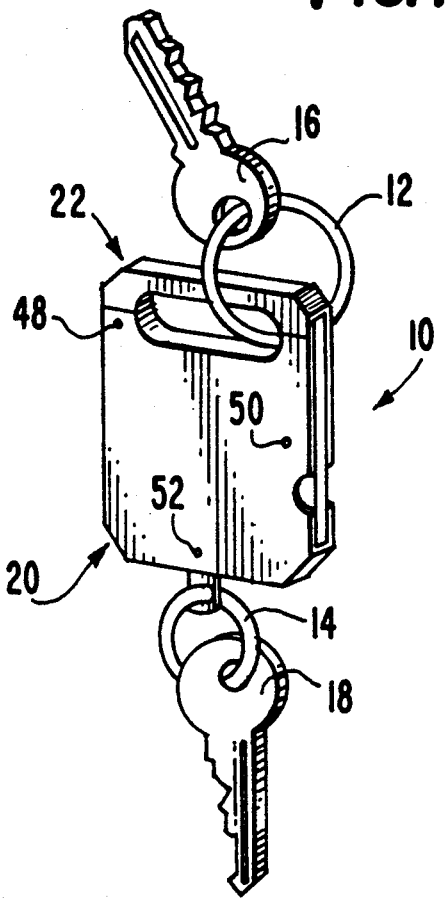
FIG. 2
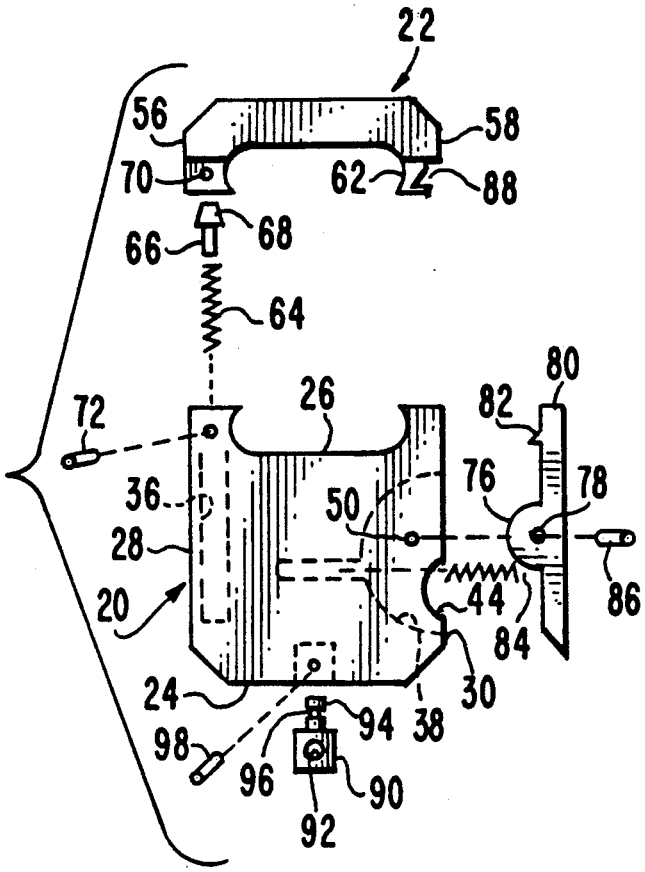
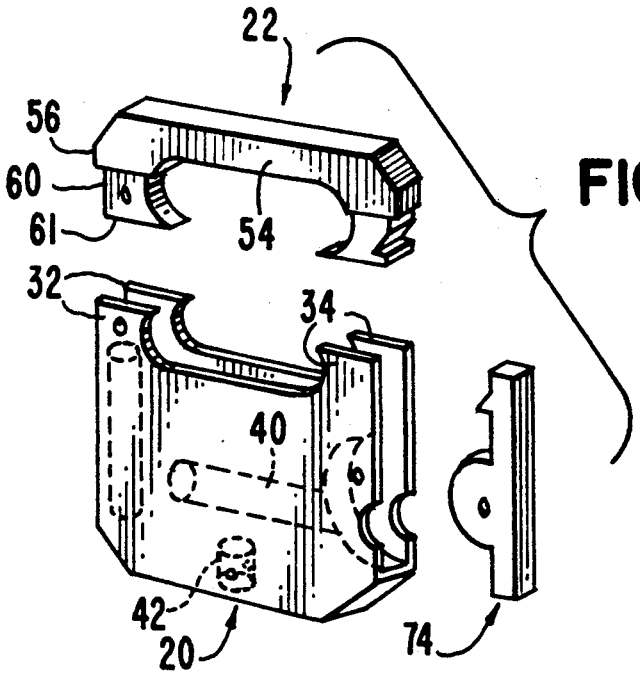
FIG. 3

KEY RING

BACKGROUND OF THE INVENTION

The present invention is directed to an improvement in key rings for retaining one or more keys on each of one or two keyholders. More specifically, the present invention relates to an improved, double ended key ring for retaining a key holder and having a unique release means for detachably removing at least one of the keyholders.

Conventional double ended key rings typically employ a pair of keyholders positioned at opposite ends of a central housing. Keys may be segregated and one or more keys placed on each of the keyholders; one or perhaps both of the keyholders is removably secured to the key ring thereby enabling the user of the keys to selectively remove keyholders (or even keys) from the double ended key ring easily.

For example, automobile keys may be placed on one end of a double ended key ring and house keys may be placed on the other end of a double ended key ring to maintain those keys as separate. Examples of conventional double ended key rings are illustrated in MacDonald U.S. Pat. Des. Nos. 271,443 of Nov. 22, 1983 and Des. 285,987 of Oct. 7, 1986.

Typical prior art double ended key rings are illustrated in U.S. Pat. No. 2,916,907 to Bridwell, U.S. Pat. No. 3,957,591 to Nadell and U.S. Pat. No. 4,821,543 to Scungio.

None of the key rings described or illustrated in the aforementioned patents provides a substantially concealed, nonobtrusive release mechanism for removing keys (or keyholders) from a key ring.

Thus there is a need for a fast, reliable, inexpensive releasing means for key rings and, in particular, for double ended key rings.

SUMMARY OF THE INVENTION

The present invention overcomes the shortcomings of the prior art by providing a new, unique and improved releasable key ring.

The present invention includes a key ring, preferably a double ended key ring, comprising a housing which is open at the top and a cover pivotably mounted relative to the housing. The cover and housing have an engaged position and an open position, and are pivotable relative to each other between the engaged and open positions. The cover and housing have an opening therebetween for retaining one or more keys (or more or more keyholders) and when the cover and housing are in the open position access is provided to the opening. When the cover and housing are in the engaged position access to the opening is prevented. A cover biasing means urges the cover into the open position and a latch is provided in the housing for maintaining the cover in the engaged position against the cover biasing means. Means are provided for releasing the latch and, in a preferred embodiment, the latch releasing means is part of the latch itself.

BRIEF DESCRIPTION OF THE DRAWINGS

The various objects of the present invention, together with other advantages and benefits which may be attained by its use, will become more apparent upon reading the following detailed description of the invention taken in conjunction with the drawings.

In the drawings, wherein like reference numerals identify corresponding ,parts of the invention:

FIG. 1 is a perspective illustrated of a double ended key ring according to the principles of the present invention;

FIG. 2 is an exploded front elevation view of the present invention; and

FIG. 3 is a partial perspective exploded illustration of a portion of the invention.

DETAILED DESCRIPTION OF THE PREFERRED EMBODIMENTS

Referring first to FIG. 1 of the drawings, a double ended key ring 10 is illustrated having a keyholder 12, 14 mounted at each end of the double ended key ring 10. A key 16 is illustrated as being mounted on the keyholder 12 and a key 18 is illustrated as being mounted on the keyholder 14.

The double ended key ring 10 includes a housing 20 and a cover 22 pivotably mounted relative to the housing.

With reference to the exploded illustrations of FIGS. 2 and 3, the housing 20 is illustrated as a generally rectangular, partially hollow box having flat front and rear faces, a first or bottom end 24, a second or top end 26 and opposed sides 28, 30. At the top end, the front and rear surfaces extend to form two pairs of laterally spaced apart ears or projections 32, 34, each pair being at one side of the housing.

The housing includes a first longitudinal bore 36 extending almost the full height of the housing, commencing at the top end 26 (opening between one pair of ears 32), and extending downwardly toward the first end 24 adjacent one side 28 of the housing. A semicircular recess 38 is provided interiorly of the housing at the second side 30. This recess 38 communicates with a bore 40 which extends substantially across the housing in a direction generally transverse to the longitudinal bore 36.

At the first end or bottom 24 of the housing a short bore 42 is provided with an axis generally parallel to the axis of bore 36. A slight depression or curved notch 44 is provided in the front and rear faces of the housing extending inwardly from the second side 30 near the vertical bottom of the recess 38.

A pair of aligned apertures 48 is provided through the front and rear housing faces generally in the center of each of the first pair of ears 32 and transversely thereof. A second pair of aligned apertures 50 is provided through the front and rear faces extending transversely through the recess 38. An aperture 52 is provided through the front face of the housing adjacent first end 24 in communication with bore 42.

The cover 22 is a generally thin, flat, solid C-shaped member having a base or top 54 and opposed legs 56, 58. Depending downwardly from the legs 56, 58 are a pair of projections 60, 62, respectively. The projections are of a reduced thickness, front to back, compared to the thickness of the remainder of the cover 22, and the underside 61 of projection 60 is inclined. The thickness and width of projection 60 is such that it fits between the pair of ears 32. The thickness and width of projection 62 is such that it fits between the second pair of ears 34. The facing interior surfaces of the projections 60, 62 and of the ears 32, 34 are curved and with the cover assembled to the housing with projections 60, 62 between their associated pairs of ears a generally rectangular opening with flat sides and curved ends is defined therebetween.

Means are provided for biasing the cover into an open position relative to the housing. Specifically, a compression spring 64 is placed within the bore 36 and a bearing rod 66, having an enlarged head 68 which functions as a bearing surface, is inserted into the bore 36 after the spring 64 has been placed within the bore. The enlarged head 68 of the rod, and more particularly the top of the head 68 will bear against the underside of the projection 60 such that when the cover 22 is pivotably mounted relative to the housing, the force of the compression spring on the rod 66 is transferred to the inclined bottom 61 of the projection 60 to urge the cover into an open position relative to the housing.

Means are provided for pivotally mounting the cover and housing relative to each other. Specifically, an aperture 70 is provided through the projection 60 and a pivot pin or rod 72 is provided. The diameter of aperture 70 is preferably larger than the diameter of pin 72 and aperture 48 such that when projection 60 is inserted between ears 32 and apertures 48 and 70 aligned, pin 72 may be inserted through apertures 48 and 70 so as to pivot the cover and housing together. The pin may be force fit into aperture 48. Alternate fastening is, of course, feasible.

Means are provided to latch the housing and cover in the engaged position to close the opening therebetween and for selectively releasing the latch. With reference to the drawings, and in particular FIGS. 1 and 2, the latch means and latch release means includes an elongated, thin rectangular latch bar 74 having a semicircular protuberance 76 on one side intermediate the opposite ends of the latch bar. An aperture 78 is provided transversely of the protuberance. A first end 80 of the latch bar includes a tooth 82 formed of an inclined surface which tooth extends laterally of the latch bar on the same side thereof as the protuberance 76. A compression spring 84 is provided and with the spring 84 positioned in the bore 40, the latch bar protuberance 76 may be inserted within the recess 38 until apertures 50 and 78 are aligned. Thereafter, a pivot pin or rod 86 is force fit into aperture 50 and through the slightly larger diameter aperture 78 to pivotally secure the latch bar 74 relative to the housing. In the orientation illustrated in FIGS. 1, 2, and 3 the spring 84 urges the latch bar counterclockwise. The projection 62 includes a slot 88 configured to receive the tooth 82 such that when the key ring is assembled as described the cover 22 may be pivoted clockwise relative to the housing such that the projection 62 moves between the pair of ears 34. The projection 62 bears against the inclined surface of the tooth 82 to move the latch bar 74 clockwise against the force of the compression spring 84 until the cover 22 is completely closed relative to the housing. At that time, spring 84 urges the latch bar counterclockwise such that the tooth 82 engages the slot 88. In this closed or engaged position there is no access to the elongated opening between the cover and housing.

The key ring of the present invention includes a rotatably mounted connector 90 having a bore 92 therethrough to receive a keyholder 14. The connector 90 is a generally cylindrical member having a reduced diameter portion 94 with a circumferential groove 96 therein. The reduced diameter portion 94 is configured to be of slightly smaller diameter than the diameter of bore 42 such that the reduced diameter portion of the connector may be inserted into the bore 42 until the circumferential groove 96 is aligned relative to the aperture 52. A pin 98 may thereafter be force fit through the aperture 52 into the reduced groove 96 such that the connector 90 is rotatably secured to the housing but longitudinal movement is precluded.

The operation of the key ring of the present invention will now be explained. With the key ring in the engaged position as illustrated generally in FIG. 1, if it is desired to remove the keyholder 12, the latch bar 74 is moved clockwise by external pressure exerted toward the first side 28. This may be conveniently done by pressing against the latch bar 74 and, as the latch bar pivots in a clockwise direction, the semicircular depression 44 would accommodate the thumb or finger of a person utilizing the key ring of the present invention.

In response to the clockwise movement of the latch bar, tooth 82 is disengaged from slot 88 and the cover 22 pivots in a counterclockwise direction under the urging of the biasing spring 64. This provides access to the opening such that the keyholder 12 may be removed. In this fashion, keys such as automobile ignition keys may remain with the vehicle while house keys may be retained by the user of the key ring. Spring 84, of course, urges the latch bar back to a vertical position as soon as the external pressure on the latch bar is released.

After the keyholder 12 has been removed (or replaced within the opening) the cover 22 is manually pivoted in a clockwise direction against the bias spring 64, until the projection 62 bears against the tooth 82 temporarily causing the latch bar to pivot clockwise until the projection 62 is seated between the pair of ears 34 at which time the spring 84 will urge the latch bar counterclockwise until the tooth 82 engages the slot 88 in the projection 62.

It should be appreciated that in lieu of a keyholder, an actual key may be engaged within the opening if the key has a sufficiently large aperture therein.

In the embodiment of the present invention, each of the springs are preferably stainless steel and the other components are brass. After the key ring is assembled, conventional metal finishing is employed such as sanding (tumbling), polishing and decorative plating. The key ring may be made of other strong or rigid materials such as plastics, wood, etc. The housing may, of course, be embossed with a trademark or a logo of an automobile manufacturer or with other decorative designs. The various directions such as top, bottom, clockwise, etc., are purely for illustrative purposes.

The foregoing is a complete description of the preferred embodiment of the present invention. Numerous changes may be made without departing from the spirit and scope of the present invention. The invention, therefore, should be limited only by the following claims.

What is claimed is:

1. A key ring, comprising:

a housing having an end and having a side that is transverse to the end;

an elongated cover having first and second ends, the cover having a slot adjacent the second end;

means for pivotably mounting the first end of the cover at the end of the housing, the cover being movable with respect to the housing between an engaged position and an open position, the housing and cover together defining an opening for retaining at least one key holder in the engaged position and the second end of the cover being spaced apart from the end of the housing in the open position; and means for releasably latching the cover in the engaged position, the means for latching including an elongated latch bar having a tooth, means for pivotably mounting the latch bar at the side of the housing so that the tooth is positioned to engage the slot adjacent the second end of the cover when the cover is in the engaged position and so that the latch bar is directly manually accessible, and spring means for urging the tooth into the slot when the cover is in the engaged position.

2. The invention as defined in claim 1 and further including means for biassing the cover and housing into said open position.

3. The invention as defined in claim 1 wherein said latch bar has an inner side which is concealed within the housing when said housing and cover are in the engaged position.

4. The invention as defined in claim 1, wherein the side of the housing has a notch, wherein a portion of the latch bar is disposed in the notch when the tooth engages the slot, and wherein the portion of the latch bar that is disposed in the notch recedes as the latch bar is pivoted to disengage the tooth from the slot.

5. The invention as defined in claim 1, wherein the cover has an elongated spine with a longitudinal axis, wherein the latch bar has a longitudinal axis, and wherein the axis of the spine of the cover is approximately perpendicular to the axis of the latch bar when the tooth engages the slot.

6. The invention as defined in claim 1, wherein the cover and the latch bar are pivotably movable in a common plane, the common plane extending through the end of the housing and the side of the housing.

7. The invention as defined in claim 6, wherein the housing has an addition end through which the common plane extends, the side of the housing being disposed between the end and the additional end, and further comprising means at the additional end of the housing for retaining at least one additional key holder.

8. The invention as defined in claim 1, wherein the latch bar has an elongated outer side which is visible from outside the housing for substantially its entire length.

* * * * *